US008069515B1

(12) United States Patent
Tingey

(10) Patent No.: US 8,069,515 B1
(45) Date of Patent: Dec. 6, 2011

(54) ORTHOPEDIC PILLOW WITH SHOULDER RECESS

(76) Inventor: Craig Tingey, Las Vegas, NV (US)

( * ) Notice: Subject to any disclaimer, the term of this patent is extended or adjusted under 35 U.S.C. 154(b) by 0 days.

(21) Appl. No.: 13/113,723

(22) Filed: May 23, 2011

Related U.S. Application Data

(60) Provisional application No. 61/352,216, filed on Jun. 7, 2010.

(51) Int. Cl.
*A47G 9/10* (2006.01)
*A47C 20/00* (2006.01)

(52) U.S. Cl. ..... 5/632; 5/636; 5/646

(58) Field of Classification Search ..... 5/632, 636, 5/646, 638, 639, 630; D6/601
See application file for complete search history.

(56) References Cited

U.S. PATENT DOCUMENTS

| | | | | |
|---|---|---|---|---|
| 2,295,906 | A | 9/1942 | Lacour | |
| 2,782,427 | A | 2/1957 | Ericson | |
| 3,757,365 | A | 9/1973 | Kretchmer | |
| 3,883,906 | A | 5/1975 | Sumpter | |
| 4,074,376 | A * | 2/1978 | Bond | 5/632 |
| 4,118,813 | A | 10/1978 | Armstrong | |
| D250,985 | S | 2/1979 | Armstrong | |
| 5,214,814 | A | 6/1993 | Eremita et al. | |
| 5,479,667 | A | 1/1996 | Nelson et al. | |
| 5,579,551 | A | 12/1996 | Tommaney | |
| 5,644,809 | A | 7/1997 | Olson | |
| D388,648 | S | 1/1998 | Bates | |
| 6,336,236 | B1 | 1/2002 | Dalton | |
| D475,881 | S | 6/2003 | Cole | |
| 6,671,907 | B1 | 1/2004 | Zuberi | |
| D492,533 | S | 7/2004 | Cole | |
| 7,228,580 | B2 | 6/2007 | Dalton | |
| 7,316,041 | B2 | 1/2008 | Guez | |
| D561,511 | S | 2/2008 | Peart | |
| 7,581,267 | B2 | 9/2009 | Rubio | |
| 7,908,691 | B2 * | 3/2011 | Small | 5/632 |
| 2005/0138733 | A1 | 6/2005 | Riesberg et al. | |
| 2008/0134437 | A1 | 6/2008 | Small | |
| 2009/0139031 | A1 | 6/2009 | Davis et al. | |

OTHER PUBLICATIONS

SideSleeper Pro, "Amazing Pillow Helps Correct Your Sleep Posture." Retrieved from the Internet on May 6, 2011. URL: https://www.sidesleeperpro.com.

* cited by examiner

*Primary Examiner* — Robert G Santos
(74) *Attorney, Agent, or Firm* — Marshall, Gerstein & Borun LLP

(57) ABSTRACT

An orthopedic pillow for supporting a user is disclosed. The user has a head and a torso. The pillow comprises a head rest for supporting the head of the user and a wedge-shaped portion having a tapered surface. The wedge-shaped portion is attached to and extends away from the head rest. The tapered surface of the wedge-shaped portion supports portions of the torso of the user. The wedge-shaped portion has a shoulder recess depressed from the tapered surface to receive a shoulder of the user.

6 Claims, 4 Drawing Sheets

ORTHOPEDIC PILLOW WITH SHOULDER RECESS

CROSS-REFERENCE TO RELATED APPLICATION

This application claims the benefit of U.S. Provisional Application Ser. No. 61/352,216, filed on Jun. 7, 2010, the entirety of which is incorporated herein by reference.

TECHNICAL FIELD

The present invention relates generally to orthopedic pillows, and more particularly, to orthopedic pillows that provide a recessed area for a shoulder and support for the chest wall.

BACKGROUND OF THE ART

During orthopedic surgery, the use of an axillary roll under patients who are in a lateral decubitus position is well known. Generally, the axillary roll is used to support the chest wall and relieve pressure and weight from the downward-facing shoulder. The benefits of such axillary rolls are well known in the art.

SUMMARY

Orthopedic pillows disclosed herein provide similar benefits by enabling a person to sleep or rest comfortably while lying on a side. Orthopedic pillows disclosed herein may be of particular benefit to people with various pain-causing shoulder conditions, especially when they lie on the side of the pain-causing shoulder. A common cause of such pain is impingement syndrome of the shoulder, though other causes are known.

The orthopedic pillow may provide a recess into which a shoulder of the person can be inserted.

The orthopedic pillow may further provide a wedge-shaped area upon which the torso of the person can rest and be supported thereby.

The orthopedic pillow may still further provide a head rest upon which the head of the person can rest and be supported thereby.

DETAILED DESCRIPTION OF THE PREFERRED EMBODIMENTS

Figure 1:
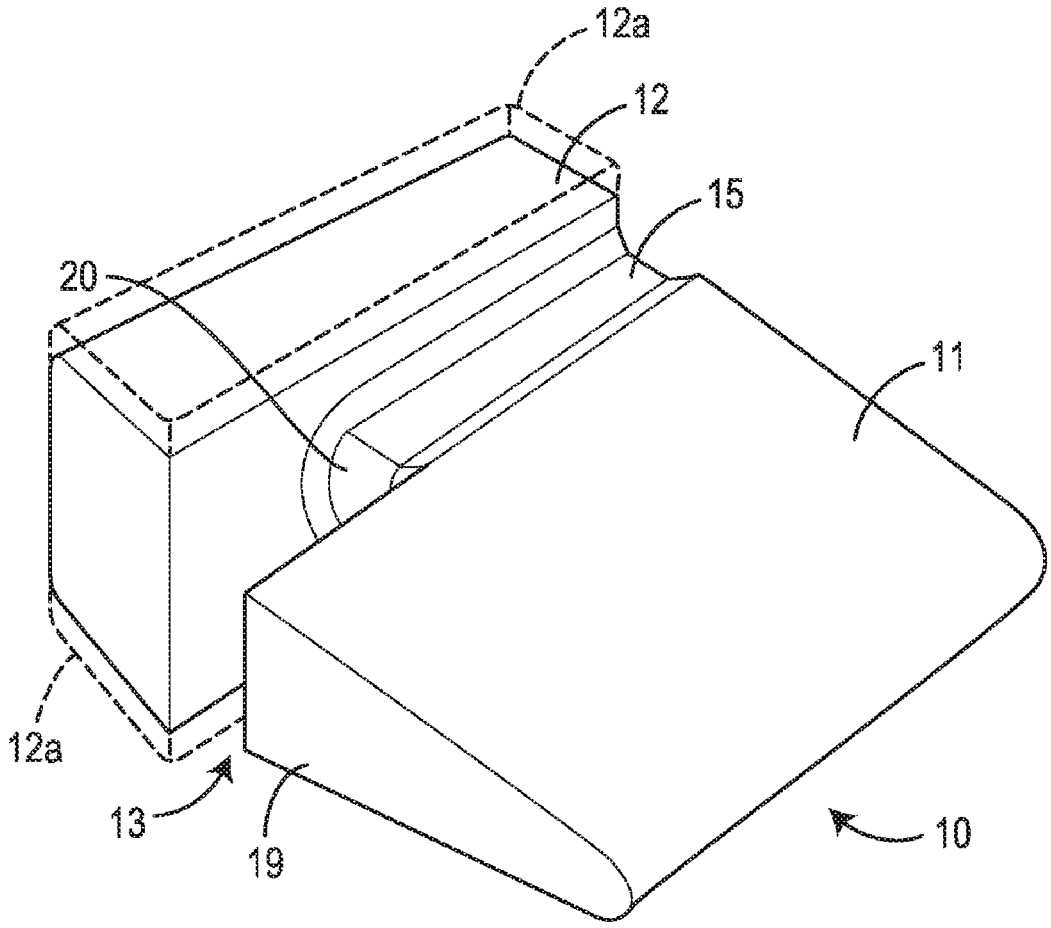
FIG. 1 is a perspective view of an orthopedic pillow in accordance with the present invention.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

A preferably one-piece orthopedic pillow, generally designated 10, is illustrated in FIG. 1. The orthopedic pillow 10 may include a generally wedge-shaped portion 11, a head rest 12 and a shoulder recess 13. The wedge-shaped portion 11 may preferably be tapered on its opposing sides. The head rest 12 may include a pillow-top cover 12*a* on one or both of its sides for added comfort.

The orthopedic pillow 10 may be made of a suitable material such as resilient foam, polyurethane, etc. The material used in the orthopedic pillow 10 may be sufficiently soft and compressible to be comfortable to a person 14 utilizing the orthopedic pillow 10 while being resilient and strong enough to maintain its basic shape and provide support against the weight of the person 14. It is contemplated that a variety of materials, including combinations of materials, could be used.

Figure 4:
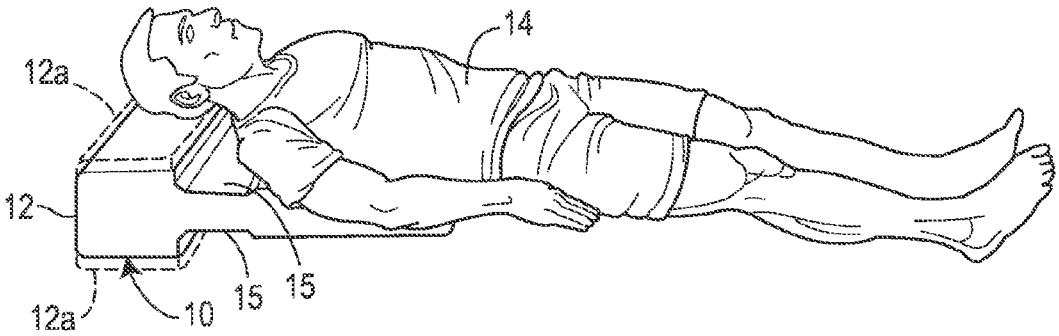
FIG. 4 is a perspective view of a person with the person lying on top of the orthopedic pillow of FIG. 1, with the back of the person facing the orthopedic pillow.

The wedge-shaped portion 11 may extend longitudinally on both its upper side and lower side (see in particular FIG. 6) along inclines to the head rest 12. Preferred dimensions of the wedge-shaped portion 11 are: 16-20 inches long (as measured along the longitudinal axis of the wedge-shaped portion 11), 6-10 inches tall at the tallest point and 32-36 inches wide. The head rest 12 may be generally a cuboid with a longitudinal axis orthogonal to the longitudinal axis of the wedge-shaped portion 11. Preferred dimensions of the head rest 12 are: 32-36 inches long, 9-15 inches tall and 9-15 inches wide. An arm channel 15 may be created between the tallest end of the wedge-shaped portion 11 and the head rest 12 by an absence of material of the orthopedic pillow 10 (FIG. 1). The arm channel 15 may be generally concave in shape. The head rest 12 is taller than the wedge-shaped portion 11 is tall, and because the wedge-shaped portion 11 is centered vertically on the head rest 12, an arm channel 15 is created both above and below the wedge-shaped portion 11 (FIG. 4). The depth of the arm channel 15 should be sufficiently large to receive an arm of the person 14 under the arm channel 15 while the orthopedic pillow 10 rests flush on a flat surface. The preferred depth of the arm channel 15, measured from the top of the head rest 12, is between 4 inches and 8 inches, inclusive.

Figure 5:
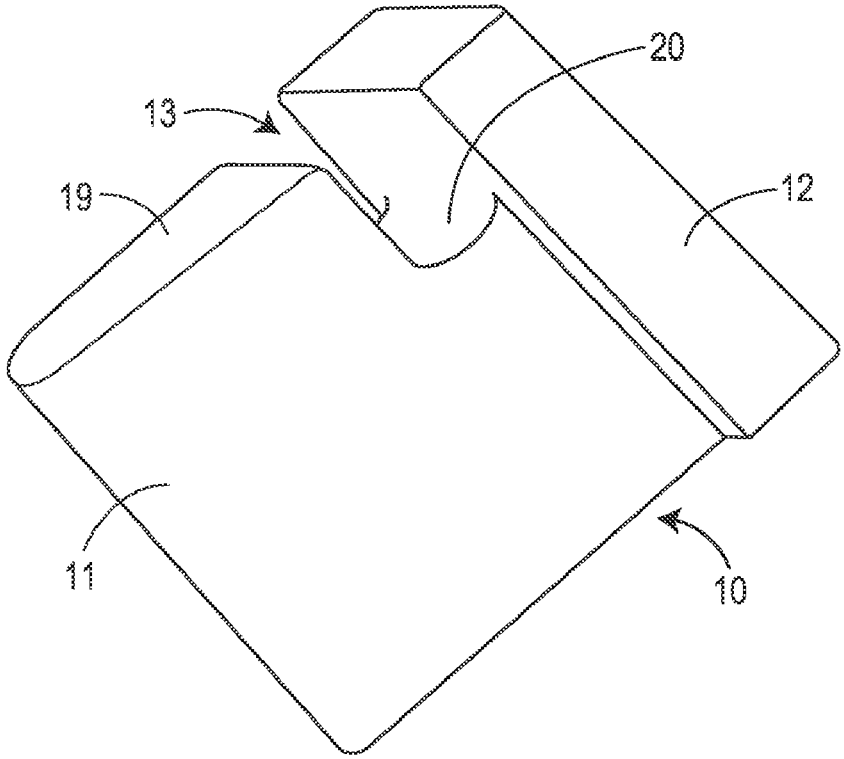
FIG. 5 is a perspective view of an alternative embodiment of an orthopedic pillow in accordance with the invention.
Figure 6:
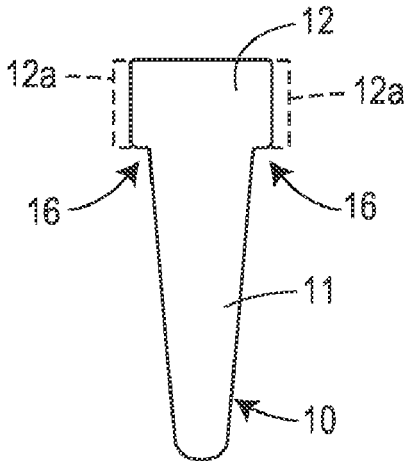
FIG. 6 is a side view of the orthopedic pillow of FIG. 5.

Alternatively, the orthopedic pillow 10 can be made without the arm channel 15. In this alternative embodiment, shown in FIGS. 5-7, the tallest end of the wedge-shaped portion 11 terminates at the head rest 12. The head rest 12 is taller than the wedge-shaped portion 11 is thick, and because the wedge-shaped portion 11 is centered vertically on the head rest 12, a lip 16 is created above and below the wedge-shaped portion 11 on the head rest 12 (FIG. 6). The height of the lip 16 should be sufficiently small to maintain the head of the person 14 at a comfortable angle with respect to the torso of the person 14, but should also be sufficiently large to receive the arm of the person 14 under the wedge-shaped portion 11. The preferred height of a lip 16 is between 1 inch and 3 inches, as measured from the top of the wedge-shaped portion 11 to the top of the head rest 12.

The shoulder recess 13 may be formed by an absence of material between the wedge-shaped portion 11 and the head rest 12 on a shoulder side 19 of the orthopedic pillow 10. The shoulder recess 13 may extend from the face of the shoulder side 19 to a contoured edge 20, which abuts each of the arm channels 15. A preferred width of the shoulder recess 13, as measured from the head rest 12 to the wedge-shaped portion 11, is 6-8 inches. The contoured edge 20 may be any shape, but a preferred shape is generally semi-circular as this shape best accommodates a shoulder.

Figure 7:
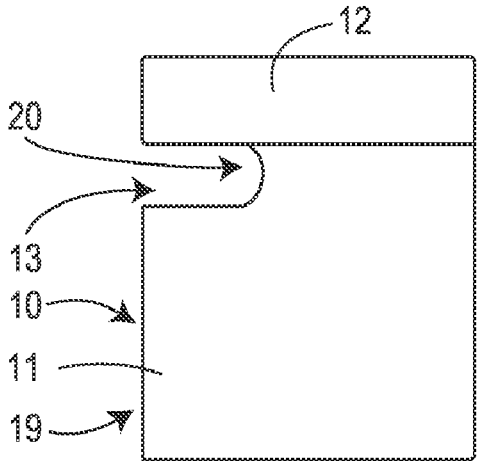
FIG. 7 is a plan view of the orthopedic pillow of FIG. 5.

In the embodiment of the orthopedic pillow 10 that has no arm channel 15, the shoulder recess 13 may be formed by an absence of material through the height of the wedge-shaped portion 11 where the wedge-shaped portion 11 meets the head rest 12 on a shoulder side 19 of the wedge-shaped portion 11 (FIG. 7). The shoulder recess 13 may extend from the face of the shoulder side 19 to a contoured edge 20. The contoured edge 20 may be any shape, but a preferred shape is generally semi-circular as this shape best accommodates a shoulder.

A person wishing to relieve pressure to the shoulder on the same side that the person is lying is able to do so by placing the torso of the person on the wedge-shaped portion 11, the shoulder into the shoulder recess 13 and the head onto the head rest 12. In the configuration just described, the person using the orthopedic pillow 10 experiences a benefit which is that the chest wall and head of the person are independently supported to remove pressure from the shoulder which is able to be positioned comfortably.

Figure 2:
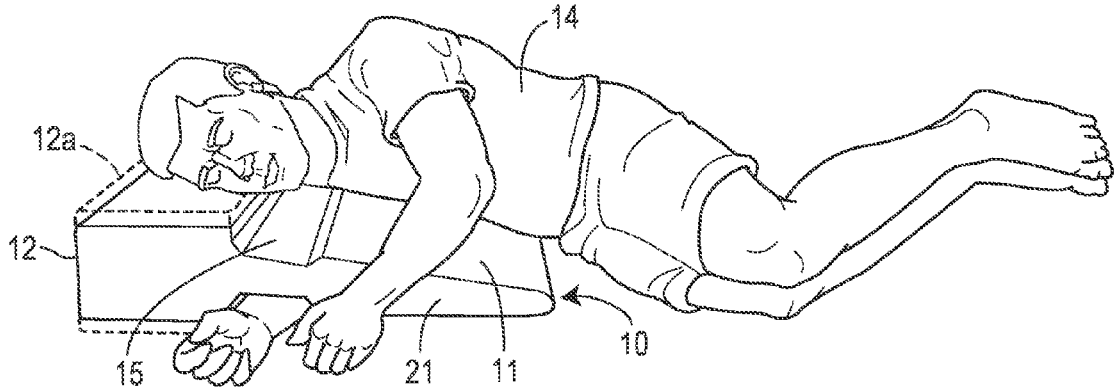
FIG. 2 is a perspective view of a person with the person's arm passing under the orthopedic pillow of FIG. 1.
Figure 3:
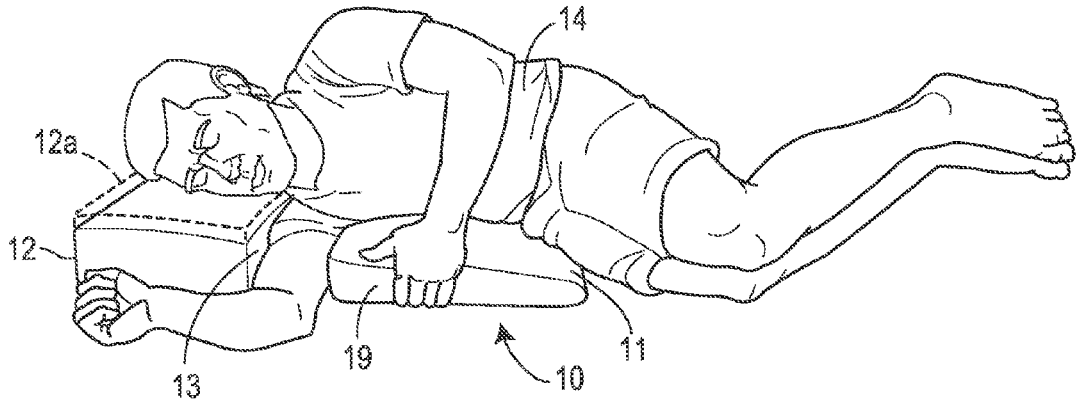
FIG. 3 is a perspective view of a person with the person's arm extending from the orthopedic pillow of FIG. 1 without passing under the orthopedic pillow.

Two preferred uses of the orthopedic pillow 10 are shown in FIGS. 2-3. In one preferred use, shown in FIG. 2, the non-recessed side 21 of the pillow 10 faces the same direction as the person 14. The person 14 is lying in the right lateral decubitus position with the right shoulder placed in the shoulder recess 13 and with the right arm extending forward and away from the person 14, under the wedge-shaped portion 11 in the space created by the arm channel 15. In another preferred use, shown in FIG. 3, the recessed side 19 of the pillow 10 faces the same direction as the person 14. The person 14 is lying in the right lateral decubitus position with the right shoulder placed in the shoulder recess 13 and with the right arm extending forward and away from the person 14. The two preferred uses just mentioned can be modified by replacing references to the right shoulder with the left shoulder wherever the right shoulder is used and by placing the person 14 in a left lateral decubitus position.

Yet another use of the orthopedic pillow 10 is shown in FIG. 4. The person 14 is lying in the dorsal decubitus position with the back of the person 14 resting on the wedge-shaped portion 11 and the head of the person 14 resting on the head rest 12.

While specific embodiments have been illustrated and described, numerous modifications may come to mind without significantly departing from the spirit of the invention, and the scope of protection is only limited by the scope of the accompanying claim.

I claim:

1. An orthopedic pillow for supporting a user experiencing shoulder pain, the user having a head and a torso, the pillow comprising:

a head rest for supporting the head of the user; and a wedge-shaped portion having symmetrically opposing, linearly tapered top and bottom surfaces relative to the head rest, the wedge-shaped portion attached to and extending away from the head rest, the tapered surfaces of the wedge-shaped portion for supporting portions of the torso of the user;

wherein the wedge-shaped portion has a common shoulder recess extending through the entirety of the wedge shaped portion to receive the shoulder of the user; and wherein each of the tapered surfaces includes a respective arm channel in general alignment with the shoulder recess and spaced below the head rest for receiving an arm of the user in a substantially non-abducted position.

2. The pillow of claim 1 wherein the head rest includes a pillow-top covering.

3. The pillow of claim 1 wherein the head rest and the wedge-shaped portion are integral.

4. The pillow of claim 1, wherein the pillow is formed of a resilient material.

5. The pillow of claim 4, wherein the resilient material is foam.

6. The pillow of claim 4, wherein the resilient material is polyurethane.

* * * * *